US007273991B2

(12) United States Patent
Korultay et al.

(10) Patent No.: US 7,273,991 B2
(45) Date of Patent: Sep. 25, 2007

(54) HANDLE FOR DOORS OR HINGED FLAPS OF VEHICLES

(75) Inventors: Erkan Korultay, Wuppertal (DE); Marion Kilian, Velbert (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/564,343

(22) PCT Filed: Jul. 6, 2004

(86) PCT No.: PCT/EP2004/007360

§ 371 (c)(1),
(2), (4) Date: Jan. 11, 2006

(87) PCT Pub. No.: WO2005/008003

PCT Pub. Date: Jan. 27, 2005

(65) Prior Publication Data

US 2006/0180447 A1 Aug. 17, 2006

(30) Foreign Application Priority Data

Jul. 15, 2003 (DE) ..... 103 31 947

(51) Int. Cl.
*H01H 9/00* (2006.01)

(52) U.S. Cl. ..... 200/61.62; 200/61.85; 200/520

(58) Field of Classification Search ..... 200/61.62–85, 200/302.1, 302.2, 520–341, 600, 332.2; 292/116, 292/117, 347; 340/5.72
See application file for complete search history.

(56) References Cited

U.S. PATENT DOCUMENTS

| | | | | |
|---|---|---|---|---|
| 6,626,473 | B1 * | 9/2003 | Klein et al. | 200/302.2 |
| 2003/0122556 | A1 * | 7/2003 | Sueyoshi et al. | 324/686 |

FOREIGN PATENT DOCUMENTS

| | | | |
|---|---|---|---|
| DE | 44 21 275 | | 1/1995 |
| DE | 196 17 038 | | 11/1997 |
| DE | 100 20 172 | | 1/2001 |
| EP | 1 014 405 | | 6/2000 |
| FR | 2 819 538 | | 7/2002 |
| JP | 2001152710 | A * | 6/2001 |
| JP | 2004169427 | A * | 6/2004 |
| JP | 2004324051 | A * | 11/2004 |
| WO | 01/20108 | | 3/2001 |

* cited by examiner

*Primary Examiner*—Elvin Enad
*Assistant Examiner*—M. Fishman
(74) *Attorney, Agent, or Firm*—Fredrich Kueffner

(57) ABSTRACT

The invention relates to a handle with an integrated switch (20) for doors or hinged flaps of vehicles. The push-button switch is essentially made up of two components which can be fitted together. The first component (21) is made of a single-pieced injection-moulding product made of three plastic components which comprise a solid covering-shaped housing and an elastic membrane. Said membrane closes the housing cover (22) at the base on one end thereof, thus giving the component (21) a shell shape. A solid pressure activator (24) on the membrane (23) is used as the third plastic component. The second component (31) is formed from a circuit board (33) comprising connected cables (19) and a microswitch (30) mounted thereon. The second component (31) is inserted into the inside of a shell (26) of the first component (21). The circuit board (33) is oriented towards the shell opening (28) and is projected from the edge of the shell (43) of the shell-shaped component (21). Said connecting area of both components (21, 31) is secured by a safety plate (37) which covers at least the inserted circuit board (33) in certain areas. The remaining part of the shell edge of the shell-shaped component (21) is used as a mould and becomes a sealing compound (48) which closes the shell opening (28) after hardening.

8 Claims, 8 Drawing Sheets

HANDLE FOR DOORS OR HINGED FLAPS OF VEHICLES

BACKGROUND OF THE INVENTION

1. Field of the Invention

The invention concerns a handle with a built-in push-button switch. If the handle and/or the push-button switch is manually operated, a locking system in the vehicle is acted upon, which serves to lock, unlock, open, and/or close a lock in the door or hinged lid. Besides the push-button switch, the handle accommodates other electric or electronic components, such as a capacitance sensor, which already responds when a hand approaches the handle and acts on the locking system.

2. Description of the Related Art

In the previously known handle of this type (DE 196 17 038 C2), the push-button switch and the electronic components were sealed inside the handle after they had been installed. If defects developed in the bush-button switch, it was necessary to dismount the entire handle and replace it with a new handle. This was expensive and time-consuming.

Electromechanical push-button switches with a housing, an elastic membrane, and a nondeformable push button are well known (DE 34 47 085 A1, DE 42 08 087 C1). However, these were assembled from individual plastic components and were not integrated in the handles of vehicles.

An electrical snap-action switch assembled from numerous mechanical components (DE 44 21 275 A1) had a housing, which was sealed in the area of the opening after the mechanical and electrical components had been installed. A circuit board with a microswitch was not used here. There was no push button integrated in a membrane.

In the case of an actuator that is not integrated in a handle that can be independently manually actuated (DE 100 20 172 A1), it is known that a membrane can first be snapped into an opening of a frame seated on the vehicle hatch. A shell-like housing is then provided with a microswitch and an actuating lever and placed with the shell-like opening on the inner surface of the membrane. A staple is used to hold the housing shell and the membrane together. The microswitch and the actuating lever are enclosed on all sides by the housing shell and the membrane. The microswitch is actuated by pressing the membrane via the lever. Due to the assembly of this actuator on the vehicle, the production costs are high.

In a handle with an integrated push-button switch (DE 198 56 902 C2), it is known that the push-button switch can be formed from a shell-like assembly in a multiple-component injection-molding technique. The shell-like assembly consists of a soft component and a hard component, which form a combined multiple-component insert. The wall of the shell consists of the soft component, the end of which has radial snap-in elements that snap into corresponding recesses in the side of the handle. Before the insertion of the shell-like housing, the microswitch and its leads must first be installed inside the handle. A reliable seal of the installed microswitch against splashed water is not guaranteed. The assembly of the push-button switch from its components in the handle is expensive.

SUMMARY OF THE INVENTION

The objective of the invention is to develop a reliable, inexpensive handle of the aforementioned type, which can be produced quickly and easily. In accordance with the invention, essentially two assemblies are used to produce the push-button switch. There is a first assembly, which is produced as a single piece in a three-plastic-component injection-molding technique and will be referred to hereinafter simply as the "shell unit". This shell unit consists of a nondeformable shell-like housing, an elastic membrane that seals the base of the visible end of the shell, and a nondeformable push button on the membrane at the base. The shell unit has a shell-like opening on its rear side opposite the membrane. The second assembly is preassembled from the following individual parts: a circuit board with electrical feed and conduction cables and a microswitch mounted on the circuit board. This second assembly is inserted into the interior of the shell unit and thus constitutes an "insertion unit".

The position of the insertion unit in the shell-like housing of the shell unit is secured by a safety plate. The safety plate at least partially covers the circuit board of the inserted shell unit. This facilitates the last production step, in which the remaining part of the shell edge of the housing of the shell unit serves as a mold. A sealing compound is applied to this remaining shell edge. Once the sealing compound has hardened, it seals the shell opening and thus makes the housing media-tight.

It is thus possible to check the push-button switch before it is installed in the cavity of the handle. If a push-button switch fails after extended use, it can be easily replaced in the handle of the invention without having to replace the entire handle at great expense. The sealing compound used in the handle of the invention is used in small amounts and allows the push-button switch and thus the handle to be quickly produced. Finally, the handle of the invention is readily disassembled and its component parts can be easily recycled.

BRIEF DESCRIPTION OF THE DRAWINGS

Further measures and advantages of the invention are apparent from the dependent claims, the following description, and the drawings. A specific embodiment of the invention is illustrated in the drawings.

DESCRIPTION OF THE PREFERRED EMBODIMENTS

Figure 1:
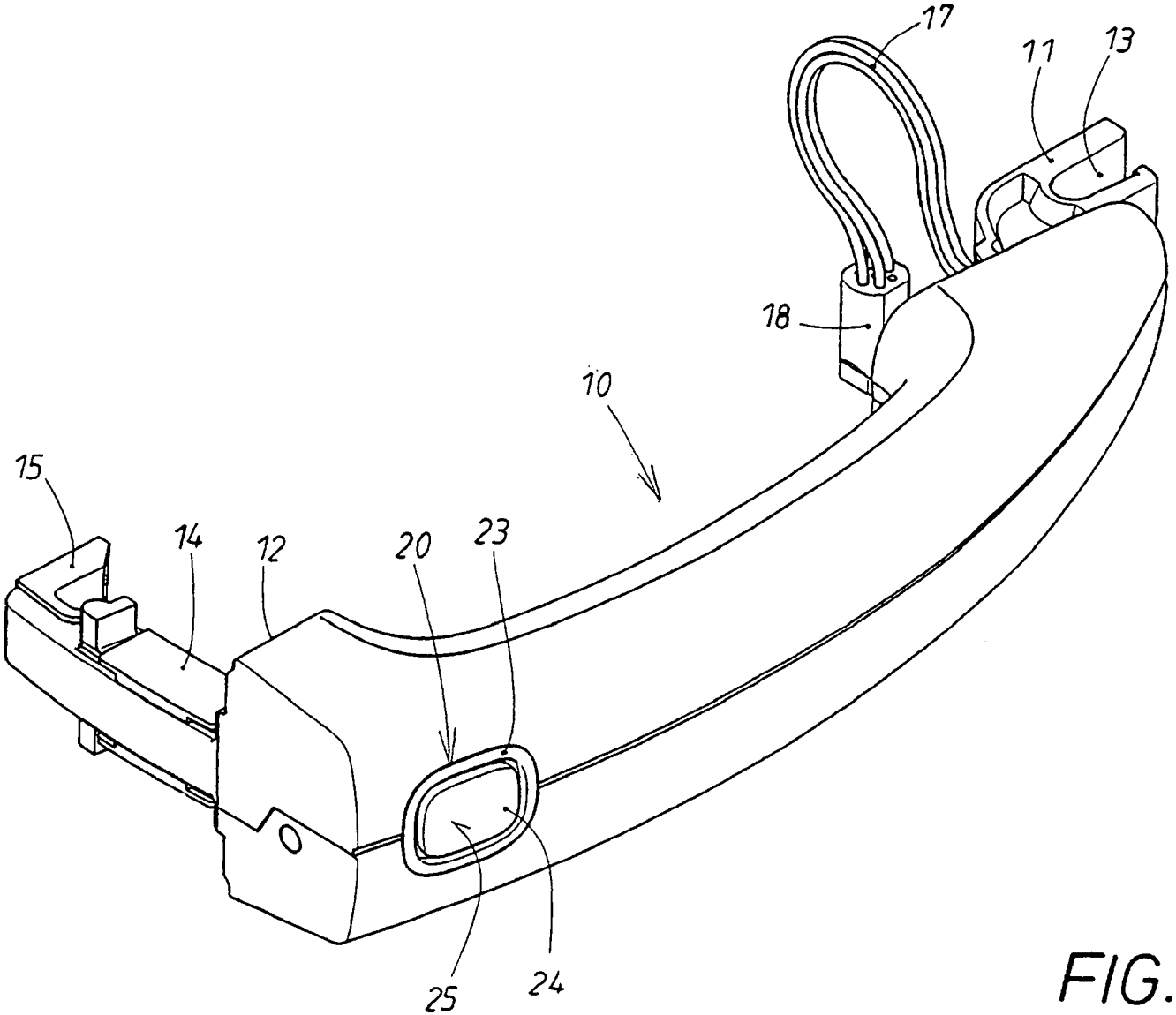
FIG. 1 is a perspective view of the handle of the invention in the unmounted state before being installed in a door.

One end 11 of the handle 10 of the invention has a bearing receptacle 13, about which the handle 10 can be manually turned when it is mounted in a door or hinged lid. At the other end 12 of the handle 10, there is a shaft 14, which engages the inside of the door and has a terminal hooked head 15, which acts on a lock located inside the door during the aforesaid turning movement of the handle 10. This operation is normally carried out to open the door when the lock is unlocked. The lock is part of a complex locking system.

Figure 2:
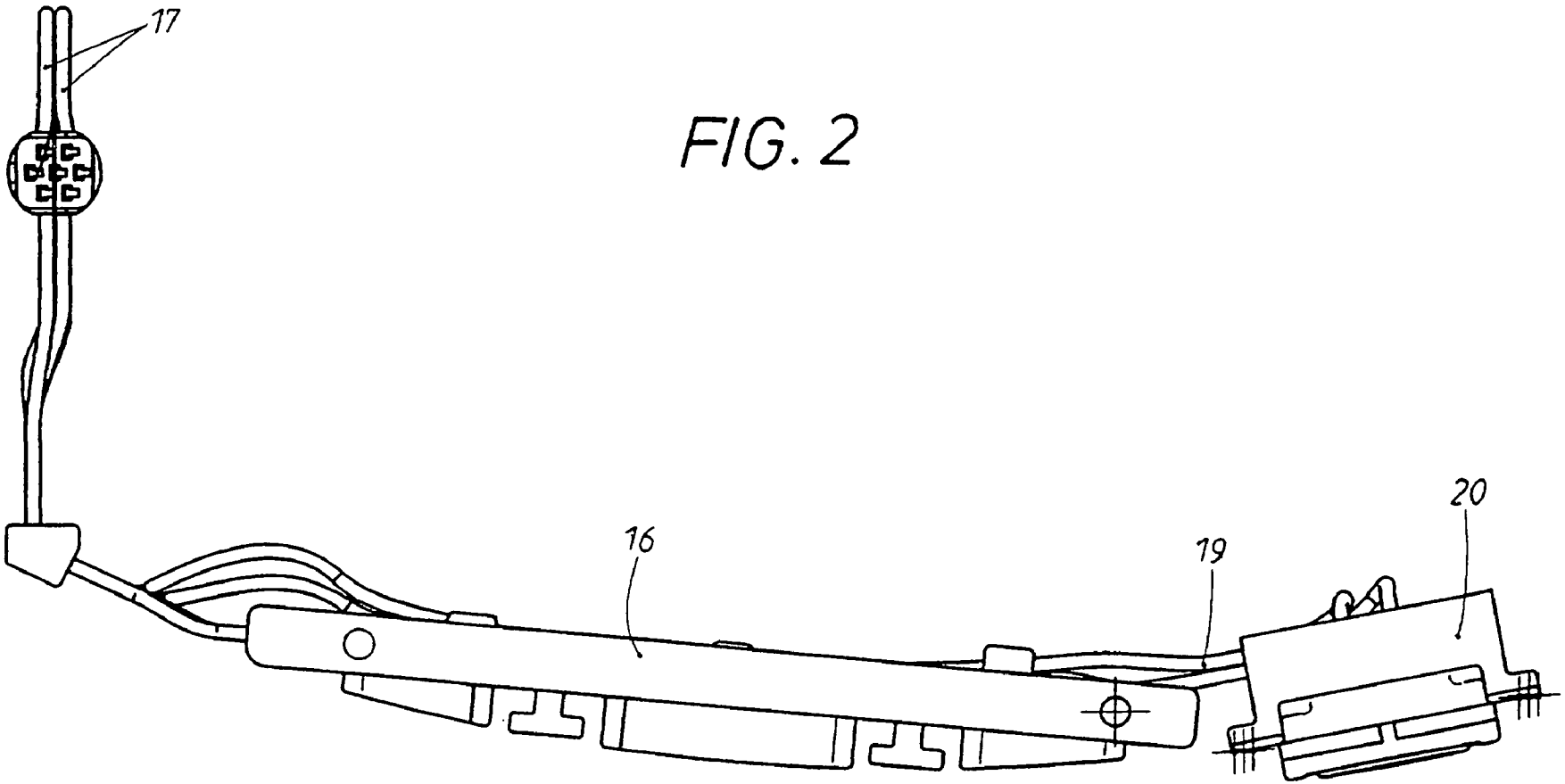
FIG. 2 shows an enlarged side view of the electrical and electronic components that are installed inside the handle shown in FIG. 1.

This locking system also includes a proximity sensor, which is integrated in the interior of the hollow handle 10. The proximity sensor 16 is shown in the unmounted state in FIG. 2 and is activated, normally by capacitance, when the hand approaches the handle 10. The generation and conduction of the sensor signals occurs via electrical cables 17, which, as shown in FIG. 1, emerge at the supported end 11 of the handle and end in an electrical coupling, such as a plug 18. Additional electronic components can be installed on the support 16 of the proximity sensor, and, in particular, cables 19 can lead off from it to a special push-button switch 20. The push-button switch 20 has the following construction, which is shown in FIGS. 3 to 9.

Figure 4:
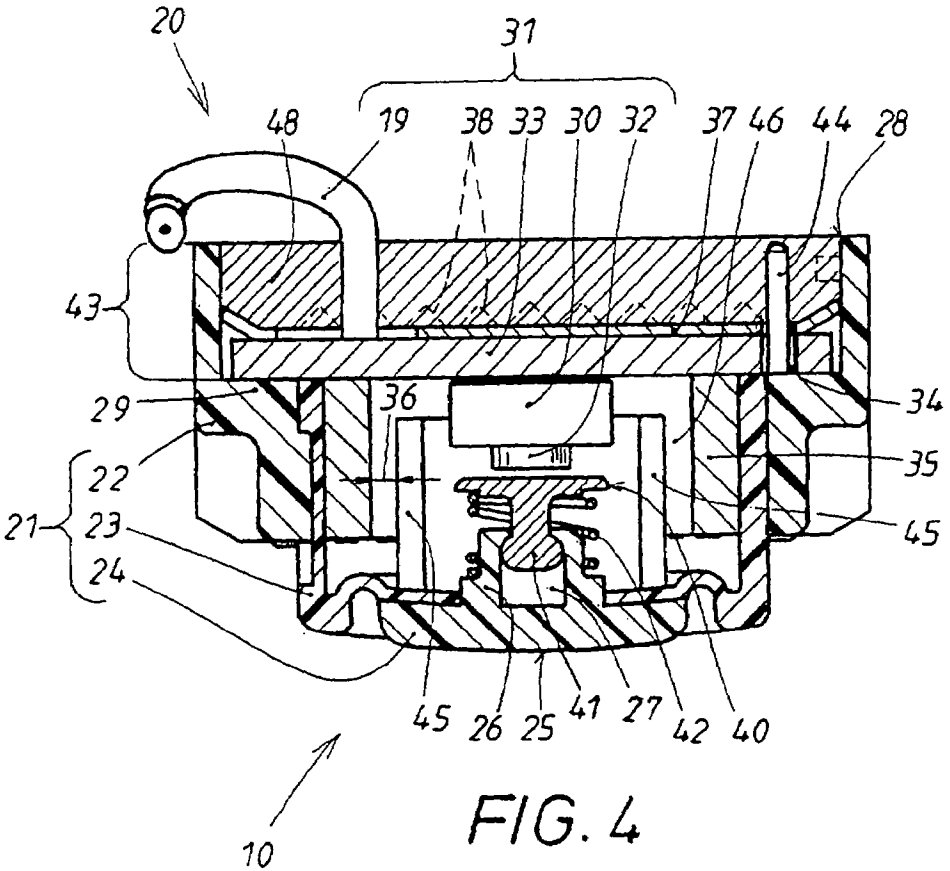
FIG. 4 shows a cross section through the push-button switch shown in FIG. 3 along the crank-shaped sectional line IV-IV in FIG. 9.
Figure 3:
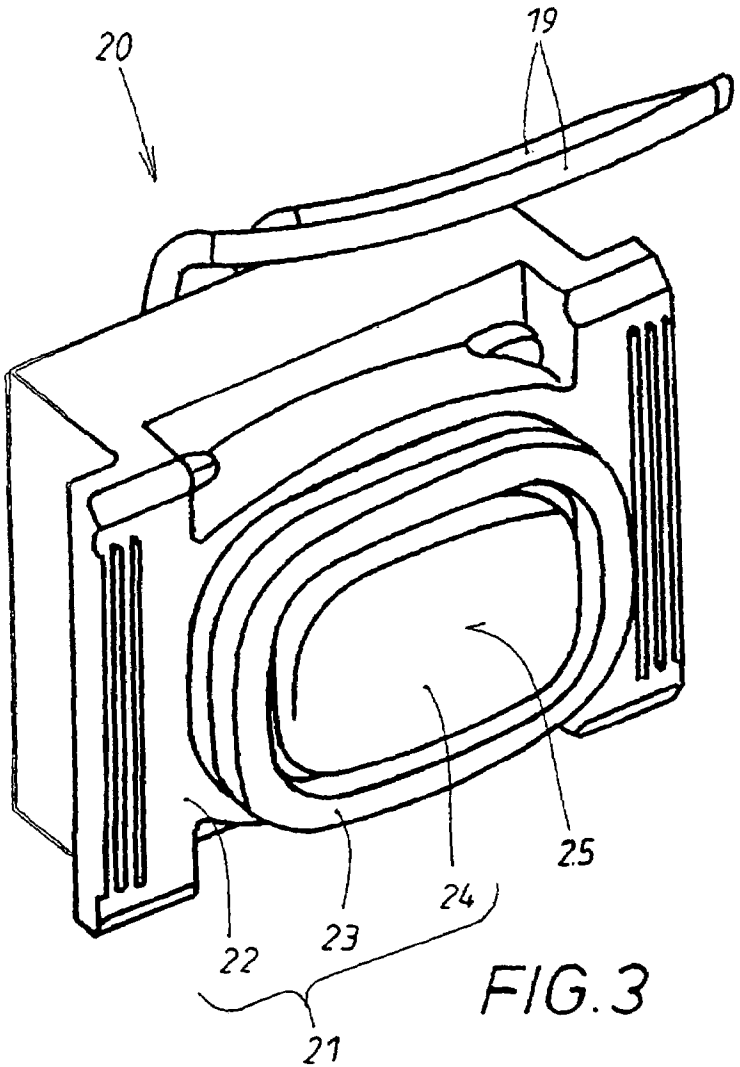
FIG. 3 shows a further enlarged, front perspective view of the push-button switch integrated in the handle.

As is shown best in FIG. 4, the first assembly 21 consists of a single-piece injection-molded part, which comprises three plastic components. There is a first, nondeformable plastic component, which forms the outer shell-like housing 22. One end of the shell-like housing 22 is sealed at the base with a profiled membrane 23, which is made of an elastic plastic and constitutes the second component, in which a push button 24 made of another nondeformable plastic is centrally integrated as the third component. The push button 24 consists of a plate, whose outer surface 25 is used for actuation. In the installed state, as shown in FIG. 1, this outer surface 25 is flush with the curved outer surface of the handle, and the lateral parts of the membrane 23 seal the opening in the handle provided for the push button. Due to the fact that this first assembly 21 is shaped like a shell, it is referred to here as the "shell unit", as has already been mentioned.

Figure 5:
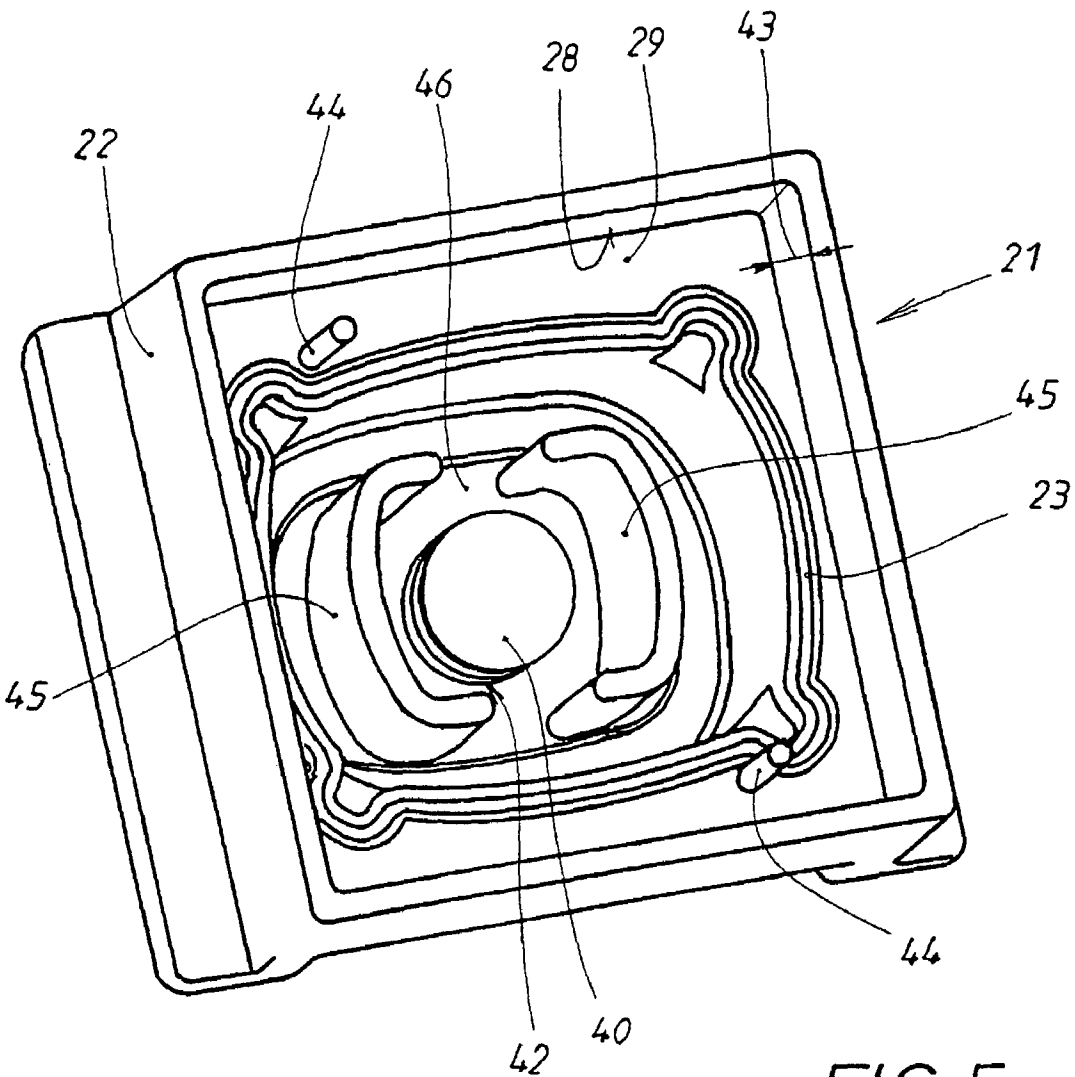
FIG. 5 shows a greatly enlarged perspective view of the rear side of a first injection-molded assembly for the push-button switch after a spring-tensioned pusher has been installed.

This shell unit 21 also includes the following additional elements, which are shown in FIGS. 4 and 5 and are also produced as a single piece with the unit 21 during the injection-molding process. These elements include, first, an axial extension 26, which is formed on the inside surface of the push button 24 and has a central receptacle 27 for a mushroom-shaped pusher 40. The pusher 40 has an expanded foot 41, which is connected with the axial extension 26 by snapping into place through a narrowed opening of the receptacle 27. The pusher 40 is held in a spring-tensioned pushed-out position in the receptacle 27 by a spring 42 arranged between its mushroom-shaped head 40 and the push button 24. FIG. 5 shows the installed position of the pusher 40 with its spring 42 in a view through the still open shell opening 28. A shell edge 43 projects a considerable axial distance beyond the base 29 of the shell on the rear side.

The shell unit 21 is provided with other single-piece members. The shell-like housing 22 is provided with an inner shoulder 29. Pins 44 are formed on the inner shoulder 29. The pins 44 run axially and are directed towards the shell opening 28 of the shell unit 21. In addition, two segmental projections 45 are formed on the inner surface of the push button 24. These projections pass through the membrane layer 23, extend axially into the interior 46 of the shell, and are positioned a certain radial distance from the aforementioned pusher 40.

Figure 6:
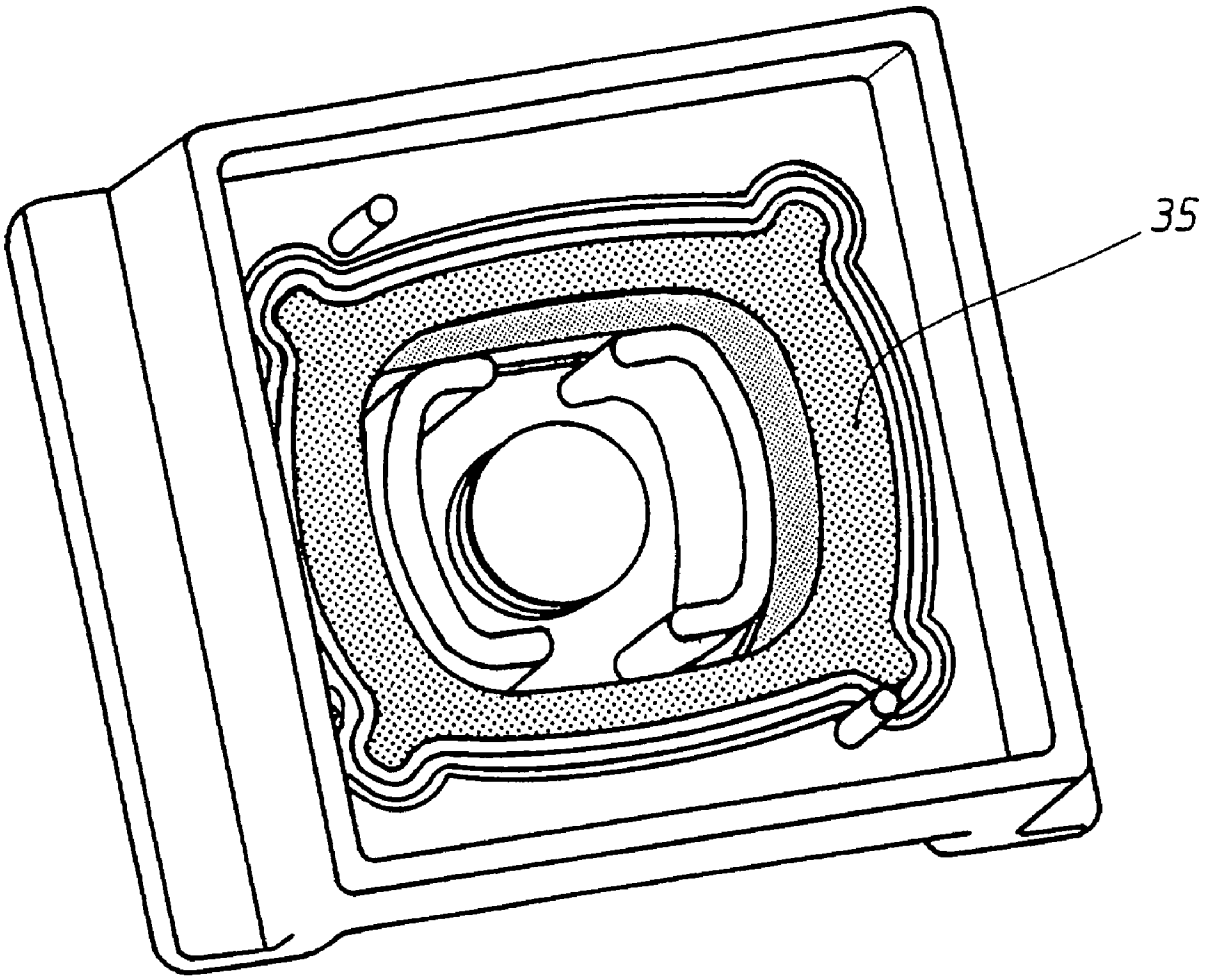
FIG. 6 shows a perspective view of the rear side of the first assembly, corresponding to the view in FIG. 5, after a volume reducer has been inserted inside the shell of the housing.

As FIG. 6 shows, a ring-shaped plastic volume reducer 35, which is shaded in FIG. 6 for emphasis, is then inserted into the interior 46 of the shell of the shell unit 21. The inside of the ring-shaped reducer 35 encloses the other central components, such as the aforementioned axial projections 45 of the shell unit 21, at a radial distance 36, which is shown in FIG. 4. The reducer 35 reduces the air volume in the interior 46 of the shell and is held by means of mutually complementary peripheral profiles of the elastic membrane 23 of the shell unit 21.

Figure 7:
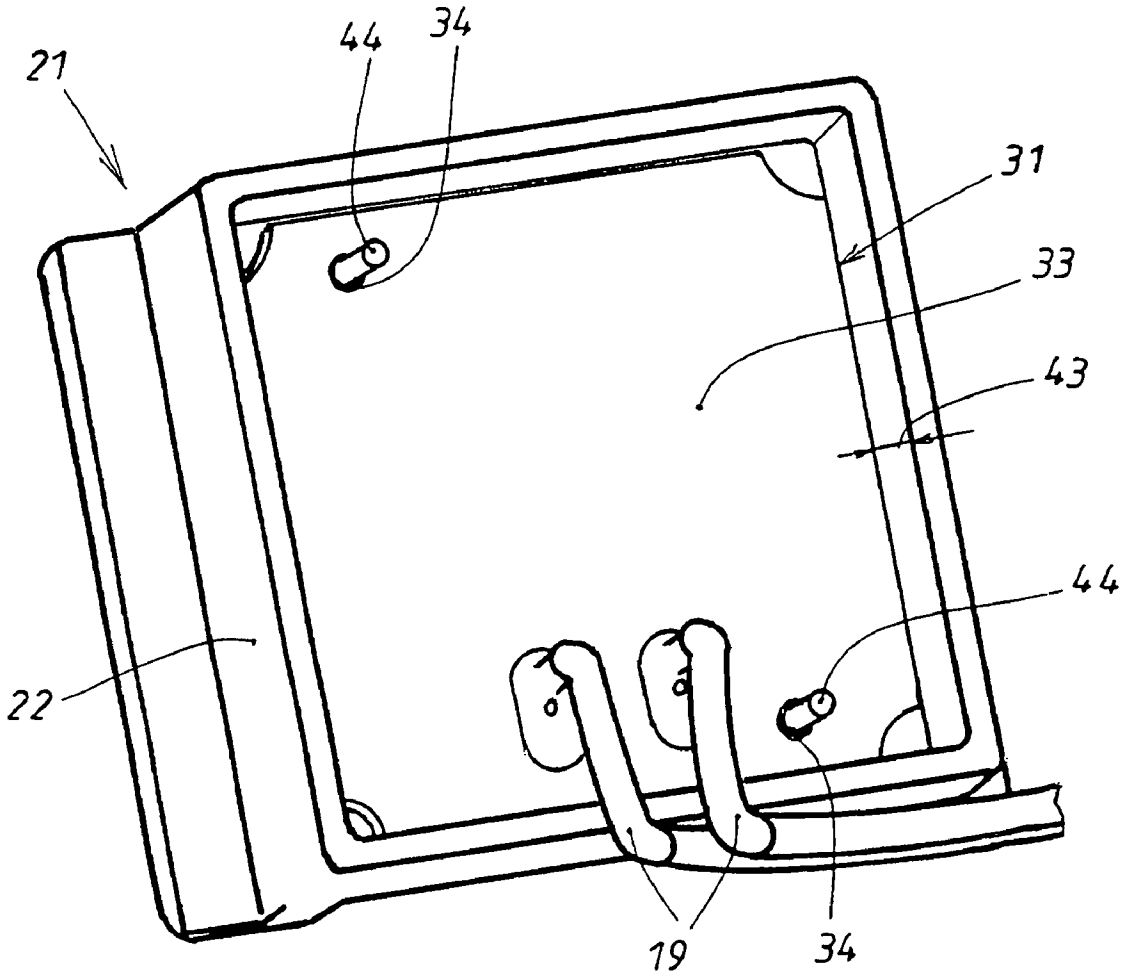
FIG. 7 shows a perspective rear view of the first assembly, corresponding to FIGS. 5 and 6; after a second assembly, which consists of a circuit board and a microswitch with attached cables, has been installed there.

The push-button switch of the invention also includes a second assembly 31, which is preassembled from its individual components. This preassembled assembly 31 is inserted into the interior 46 of the shell and therefore will be referred to herein after simply as the "insertion unit" to distinguish it from the shell unit 21. As is shown best in FIG. 4, this insertion unit comprises, first, a circuit board 33 with conducting tracks, to which the aforementioned electrical cables 19 are already connected on one of the surfaces. On the other surface of the circuit board 33, a microswitch 30 is mounted, which is in contact with the conducting tracks and has an axially movable contact actuator 32. The pins 44 are used for the insertion of the insertion unit 31 into the interior 46 of the shell. The circuit board 33 has holes 34, which are shown best in FIGS. 4 and 7, and through which the pins 44 of the shell unit 21 extend after the insertion of the insertion unit 31. As FIG. 7 shows, after the insertion unit 31 has been inserted, the housing 22 still has a projecting shell edge 43, which is used to mount additional elements, as shown in FIGS. 8 and 9.

Figure 8:
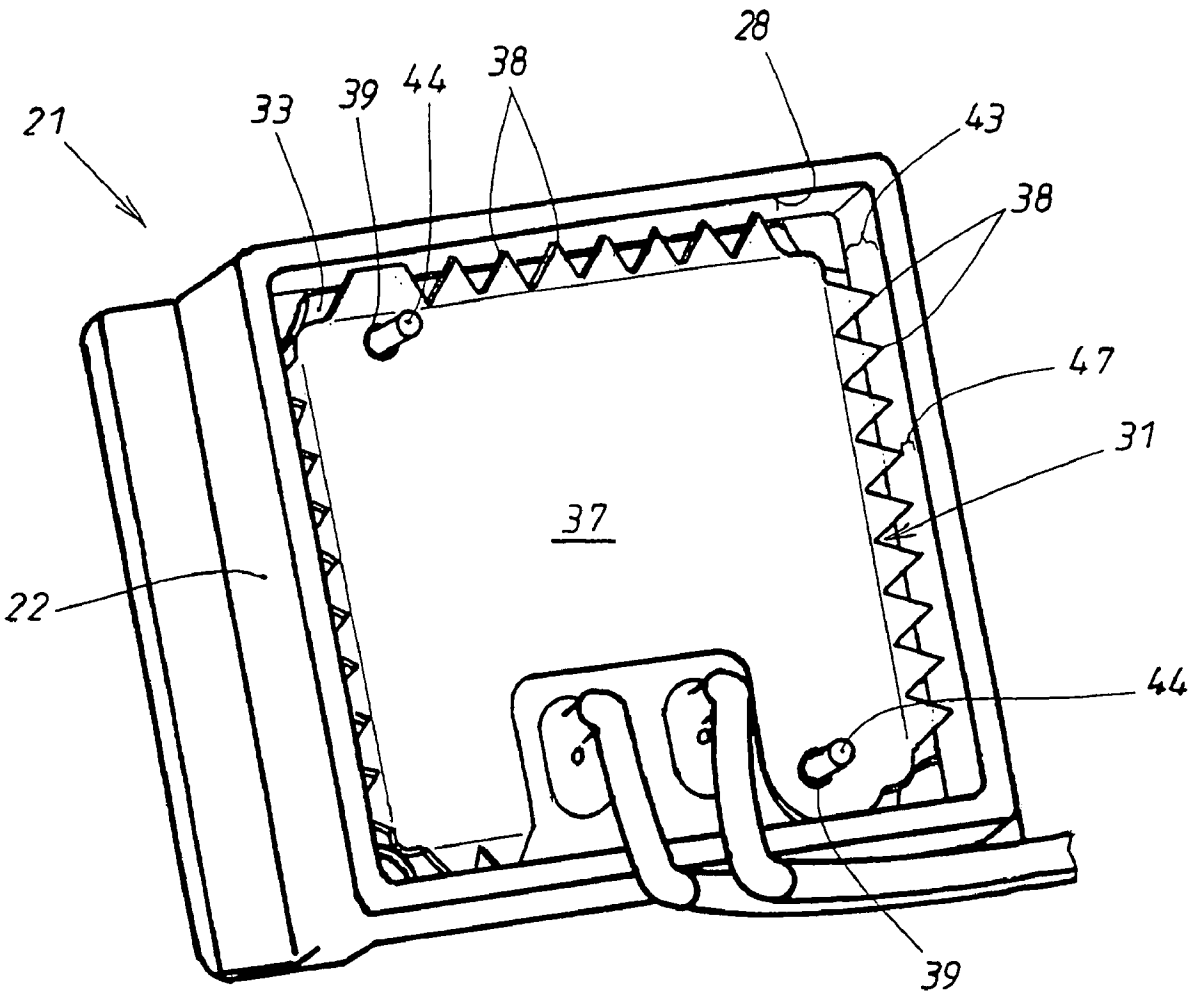
FIG. 8 shows, in the same view as FIG. 7, the following production step, where a safety plate covers the rear side of the circuit board.
Figure 9:
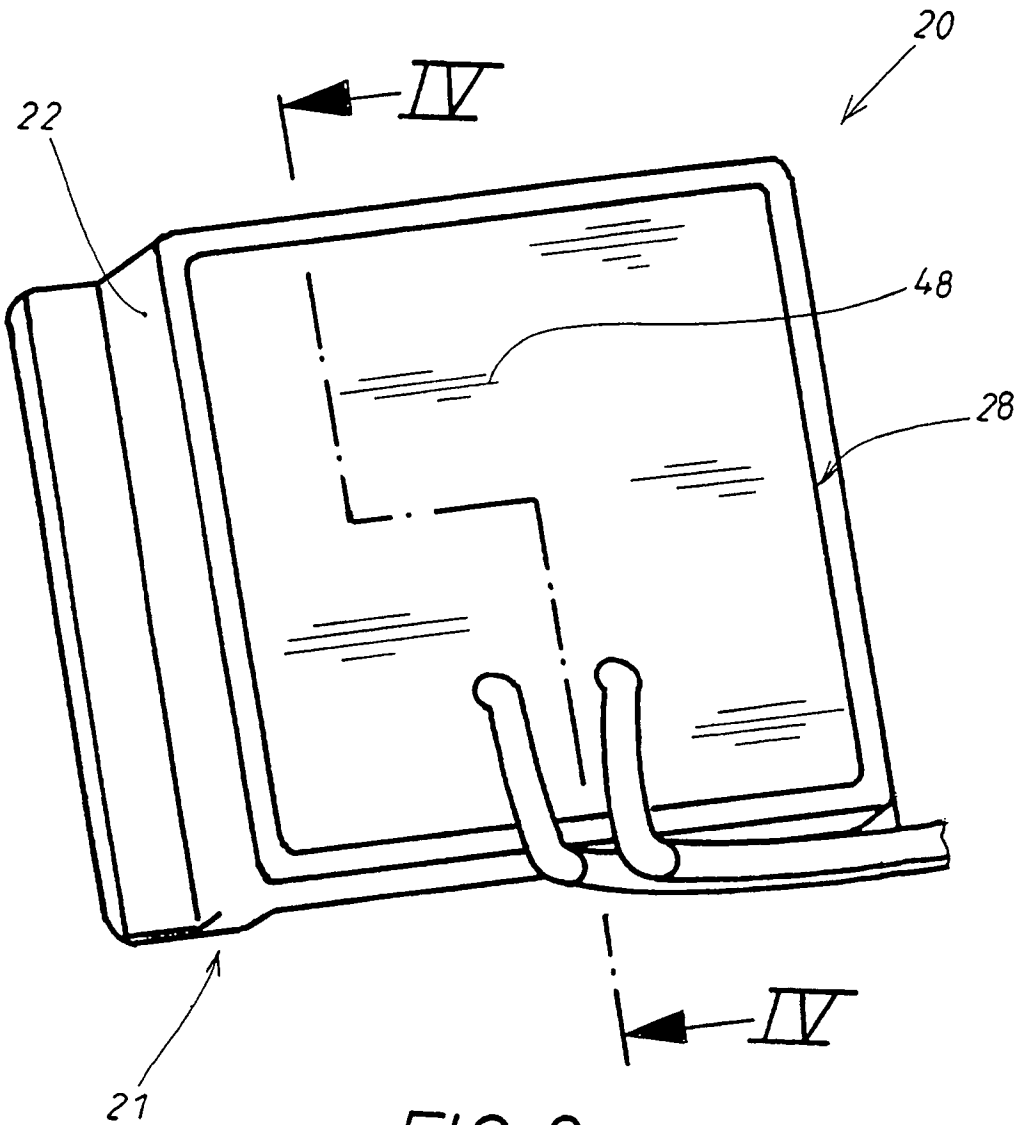
FIG. 9 shows, in the same view as in FIGS. 5 to 8, the rear side of the finished push-button switch after the projecting end of the shell has been filled in with a sealing compound.

As FIG. 8 shows, a safety plate 37 is first placed on the rear side of the inserted circuit board 33. The purpose of this safety plate 37 is to secure the position of the assembled insertion unit 31 in the shell unit 21. To this end, sharp-pointed tips 38 are provided along the periphery of the safety plate 37. When the safety plate 37 is placed on the rear side of the circuit board 33, the sharp-pointed tips 38 penetrate the projecting shell edge 43 and become fixed in the inner wall surface. This secures the assembled position of the two assemblies 21, 31. The safety plate 37 also has holes 39 that are aligned with the pins 44, which pass through the holes 39 when the safety plate 37 is mounted. This secures the radial position of the safety plate 37 behind the assembled assemblies 21, 31.

As FIG. 8 shows, a portion 47 of the shell edge 43 is left exposed behind the safety plate 37. This remaining part 47 of the shell edge 43 is used in the last production step as a mold for receiving a sealing compound 48, which is shaded in FIG. 9 for emphasis. The sealing compound 48 seals the shell opening 28 media-tight.

Instead of the separate safety plate 37, the secured position between the two assemblies 21, 31 can also be achieved by pins and holes (not shown), which are provided between the two assemblies 21, 22 and engage each other when the two assemblies are fitted together. The assemblies are then held together by deformation at the ends of the pins that extend from the holes. This deformation of the ends of the pins can be accomplished by bending or welding the ends of the pins.

The invention claimed is:

1. A handle for vehicle doors or hinged lids, the handle comprising a) a manually operated grip (10), and a manually operated push-button switch (20) integrated in the grip (10);

b) a locking system for locking, unlocking, opening and/or closing a lock in the door or hinged lid, wherein an actuation of the grip (10) or the push-button switch (20) acts on the locking system;

c) wherein the push-button switch (20) is comprised of two structural units (21, 31) which can be individually preassembled, and wherein the preassembled structural units are mounted in the grip;

d) wherein the first structural unit (21) is shell-shaped and is comprised of a nondeformable shell-like housing (22), an elastic membrane (23) for sealing the base of the visible end of the first structural unit and a nondeformable push-button (24) on the membrane (23) at the base;

e) a shell opening (28) at a rear side of the first structural unit (21) located opposite the membrane (23);

f) wherein the second structural unit (31) is preassembled from a circuit board (33) with electrical feed and conduction cables (19) and a micro switch (30) mounted on the circuit board;

g) wherein, for assembling the handle, the second structural unit (31) is inserted in a shell interior (46) of the first structural unit (21), while, in the inserted position, the first structural unit (21) protrudes with a projecting shell edge (34) beyond the rear side of the second structural unit (31);

h) a safety plate (37) for securing the inserted position of the two structural units (21, 31), wherein the safety plate (37) at least partially covers the circuit board (33) on the rear side of the inserted second structural unit (31), and wherein the safety plate (37) is secured in the projecting shell edge (43) of the first structural unit (21);

i) wherein a remaining part (47) of the shell edge (43) remains of the housing (22) of the first structural unit (21) and serves as a mold; and k) wherein the mold receives a sealing compound (48) which, after fastening, closes off the shell opening (28) of the first structural unit (21).

2. The handle according to claim 1, wherein the periphery of the safety plate (37) is provided with sharp-pointed tips (38), wherein the tips engage in the projecting shell area (43) of the first structural unit (21) for attaching the safety plate (37) to the second structural unit (31) by engaging in the projecting shell area (43) of the first structural unit (21).

3. The handle according to claim 1, wherein the components of the first structural unit (21) are assembled from the nondeformable sleeve-shaped housing (22) as well as the elastic membrane (23) and finally the non-deformable pressure actuator (24), using a multiple-component technique.

4. The handle according to claim 1, further comprising a ring-shaped volume reducer (35) mounted in the interior of the shell of the first structural component, wherein after placing the second structural unit (31) in the interior of the first structural component the annular interior of the first structural component surrounds the microswitch (31) at a radial distance.

5. The handle according to claim 1, wherein the push button (24) of the first structural unit (21) has an axial extension (26) in the shell interior (46) for receiving a springtensioned pusher (40), wherein, in the finished assembly state, the axial extension (26) is in alignment with the push button (32) of the microswitch (30) of the second structural unit (31).

6. The handle according to claim 1, wherein the push button (24) of the first structural unit (21) has in the shell interior (46) axially parallel projections (45) which at least partially like segments surround at a radial distance the pusher (40) of the first structural unit (21) and/or the microswitch (40) of the second structural unit (31).

7. The handle according to claim 1, wherein the housing (22) of the first structural unit (21) has pins (44), wherein the positions of the pins conform to an arrangement of holes (34) in the circuit board (33) of the second structural unit (31) and/or to a hole arrangement pattern (39) in the safety plate (37) which is placed over the second structural unit (31).

8. The handle according to claim 1, wherein, for securing the circuit board (33) of the second structural unit (31), pins extending though openings are provided at the housing (22) of the first structural unit (21), wherein the ends of the pins are fastened by upsetting or welding.

* * * * *